US007750862B2

(12) United States Patent
Hilgers

(10) Patent No.: US 7,750,862 B2
(45) Date of Patent: Jul. 6, 2010

(54) BROADBAND ANTENNA FOR A TRANSPONDER OF A RADIO FREQUENCY IDENTIFICATION SYSTEM

(75) Inventor: Achim Hilgers, Alsdorf (DE)

(73) Assignee: NXP B.V., Eindhoven (NL)

( * ) Notice: Subject to any disclaimer, the term of this patent is extended or adjusted under 35 U.S.C. 154(b) by 174 days.

(21) Appl. No.: 12/092,901

(22) PCT Filed: Nov. 8, 2006

(86) PCT No.: PCT/IB2006/054160

§ 371 (c)(1),
(2), (4) Date: May 7, 2008

(87) PCT Pub. No.: WO2007/054900

PCT Pub. Date: May 18, 2007

(65) Prior Publication Data

US 2008/0266191 A1 Oct. 30, 2008

(30) Foreign Application Priority Data

Nov. 10, 2005 (EP) ..... 05110618

(51) Int. Cl.
*H01Q 21/00* (2006.01)

(52) U.S. Cl. ..... 343/726; 343/793

(58) Field of Classification Search ..... 343/725, 343/726, 741, 793; 340/572.1, 572.7
See application file for complete search history.

(56) References Cited

U.S. PATENT DOCUMENTS

| | | | | |
|---|---|---|---|---|
| 5,198,826 | A | 3/1993 | Ito | |
| 6,344,792 | B1 * | 2/2002 | Tuttle et al. | 340/10.42 |
| 6,466,131 | B1 * | 10/2002 | Tuttle et al. | 340/572.7 |
| 6,891,466 | B2 | 5/2005 | Turner et al. | |
| 2009/0096696 | A1 * | 4/2009 | Joyce et al. | 343/793 |

FOREIGN PATENT DOCUMENTS

| | | | |
|---|---|---|---|
| GB | 2260065 | A | 3/1993 |
| JP | 00077928 | A | 3/2000 |
| WO | 03044892 | A1 | 5/2005 |

* cited by examiner

*Primary Examiner*—Tan Ho

(57) ABSTRACT

A broadband antenna structure (10) for a transponder of a radio frequency identification system comprises—a loop resonator (12) with a feedpoint (14) for connecting with an electronic circuit (16), and—a dipole resonator (18) electrically connected to the loop resonator (12) and comprising two electrically isolated legs (20, 22).

18 Claims, 5 Drawing Sheets

BROADBAND ANTENNA FOR A TRANSPONDER OF A RADIO FREQUENCY IDENTIFICATION SYSTEM

FIELD OF THE INVENTION

The invention relates to a broadband antenna for a transponder of a radio frequency identification system.

The invention further relates to a transponder of a radio frequency identification system.

BACKGROUND OF THE INVENTION

Radio frequency identification (RFID) systems typically comprise one or more reader powered by a battery or power supply unit and capable of communicating with RFID transponder or tags. A RFID transponder may be an active tag which is powered by a battery, or a passive tag which is powered by the high frequency field generated by the reader, or a semi active/passive tag which is activated by the high frequency field generated by the reader and uses a battery for further activities. It comprises at least electronic circuitry for storing data and communicating with a reader, and an antenna tuned with the frequency range in which the RFID transponder is operated.

Usually, different frequency ranges are provided for contact less identification systems using RFID transponder in different countries such as Japan, USA, and the European Union (EU). For example, the UHF (ultra high frequency) band, which is often used for RFID transponder, is located in the range from 902 to 928 MHz in the USA, and in the range from 863 to 868 MHz in the EU. In order to use the same RFID transponder in the USA and EU, a frequency range from about 860 MHz to about 930 MHz must be covered. U.S. Pat. No. 6,891,466 B2 discloses an antenna which is designed to cover such a broad frequency range. However, the disclosed antenna structure is a patch antenna which requires two metallization layers or a longitudinal resonator consisting of wires. These antenna structures are complex and, therefore, costly.

OBJECT AND SUMMARY OF THE INVENTION

It is an object of the invention to provide a broadband antenna for a transponder of a radio frequency identification system in which the disadvantage above is avoided.

In order to achieve the object defined above, with a broadband antenna according to the invention characteristic features are provided so that a broadband antenna according to the invention can be characterized in the way defined below, that is:

a broadband antenna for a transponder of a radio frequency identification system comprising a loop resonator with a feedpoint for connecting with an electronic circuit, and a dipole resonator electrically connected to the loop resonator and comprising two electrically isolated legs.

In order to achieve the object defined above, with a transponder according to the invention characteristic features are provided so that a transponder according to the invention comprises an antenna according to the invention and an electronic circuit to which the antenna is connected at its feedpoint.

The characteristic features according to the invention provide the advantage that the antenna has a relatively simple structure and, therefore, may be implemented at low cost compared to the antenna structures known from U.S. Pat. No. 6,891,466 B2. Furthermore, the impedance of the antenna according to the invention is easily adaptable to an impedance of an electronic circuit of a RFID transponder such that an impedance matching over a broad frequency range may be achieved. The antenna according to the invention may be designed such that at least two resonances in the frequency spectrum of the scattering parameter $s_{11}$ of the antenna may be achieved which allow improving the matching of the antenna impedance to the electronic circuit impedance. The combination of a loop structure and a dipole structure offers further parameters which may be changed for improving the impedance matching of the antenna and the electronic circuit as well as maximizing the radiant efficiency over a broad frequency range. Thus, the antenna according to the invention enables the design of a RFID transponders which may be operated in a broad frequency range such as the range from 902 to 928 MHz provided for RFID operation in the USA, and the range from 863 to 868 MHz provided for RFID operation in the EU According to a preferred embodiment, the loop resonator may comprise two electrical lines, wherein one end of each line is provided for connecting with the electronic circuit, the other end of each line is coupled to a respective one of the two electrically isolated legs of the dipole resonator, and a coupling couples the other ends of the two lines. The term "coupling" means some kind of electrical effective coupling. The coupling is a further parameter which allows adjusting the matching of the antenna impedance to the electronic circuit impedance by modifying the dimensions and, thus, the electrical behaviour of the coupling.

The coupling may be an electrical connection forming a short circuit of the two lines. This coupling is suitable for electronic circuits with a DC short circuit protected output, or in other words with two antenna connections which may be short circuited over the loop resonator.

However, for usage with an electronic circuit which does not have a DC short circuit protected output, the coupling may be a capacitive coupling structure or formed by a capacitor. Thus, a DC short circuit of the two antenna connections of the electronic circuit is prevented by the capacitive coupling or the capacitor contained in the loop structure. It should be noted that the capacitive coupling or capacitor should be a short circuit for high frequency signals which are sent out or received via the antenna. The capacitive coupling or capacitor should only prevent a DC short circuit which may have a negative influence on the DC power supply of the electronic circuit. For example, the capacitor may be implemented as a SMD device, and the capacitive coupling by two metallization areas arranged next to another or one below the other. The coupling may not only be modified by design parameters such as the distance of two metallization areas but also by changing the material between the two lines of the loop structure in the section of the coupling. For example, the coupling may comprise a material with a certain permeability coefficient $\in_r$ with a value larger than 1 in order to strengthen the coupling.

The matching of the antenna impedance to the output impedance of the electronic circuit may also be modified by selecting the dimensions and arrangement of the two electrical lines of the loop resonator such that the antenna shows at least two resonance bands in which the antenna is in a matched condition with the electronic circuit, wherein one of the two resonance bands lies in a first frequency range and the other one of the two resonance bands lies in a second frequency range different from the first frequency range.

Preferably, the lines are arranged in parallel in order to achieve predefined electrical conditions such as a predefined capacitance between the lines.

Typically, each of the lines has a predefined length and width, and both lines are arranged in a predefined distance, wherein the predefined length, width, and distance are selected such that the antenna shows at least two resonance bands in which the antenna is in a matched condition with the electronic circuit, wherein one of the two resonance bands lies in a first frequency range and the other one of the two resonance bands lies in a second frequency range different from the first frequency range.

As mentioned above, the coupling also influences the impedance of the antenna and, thus, it is preferably an electrical connection with a predefined width which may be adapted to achieve a certain impedance of the antenna.

Also the design parameters of the dipole resonator may influence the impedance matching. According to a preferred embodiment, the two electrically isolated legs of the dipole resonator are arranged over a predefined length in parallel in order to achieve a certain coupling of the two legs of the dipole resonator.

The production of the antenna may be simplified if both legs are arranged at the predefined distance of the lines of the loop resonator.

Both legs may have a first predefined width essentially equal to the width of the lines of the loop resonator at least for the predefined length for which they are arranged in parallel.

After being arranged in parallel over a first predefined length, both legs may diverge over a second predefined length and have a second predefined width in order to form a dipole structure with a high radiation efficiency.

Electrically conducting parts of the antenna are preferably electrically conducting metallization deposited on or embedded into a substrate having a dielectric constant equal or larger than 1 and a permeability coefficient equal or larger than 1.

According to a further aspect, the invention relates to a transponder of a radio frequency identification system comprising an antenna as described above and adapted to operate in the frequency range from about 860 MHz to about 960 MHz.

The aspects defined above and further aspects of the invention are apparent from the exemplary embodiments to be described hereinafter and are explained with reference to these exemplary embodiments.

BRIEF DESCRIPTION OF THE DRAWINGS

The invention will be described in more detail hereinafter with reference to exemplary embodiments. However, the invention is not limited to these exemplary embodiments.

DESCRIPTION OF EMBODIMENTS

Figure 1:
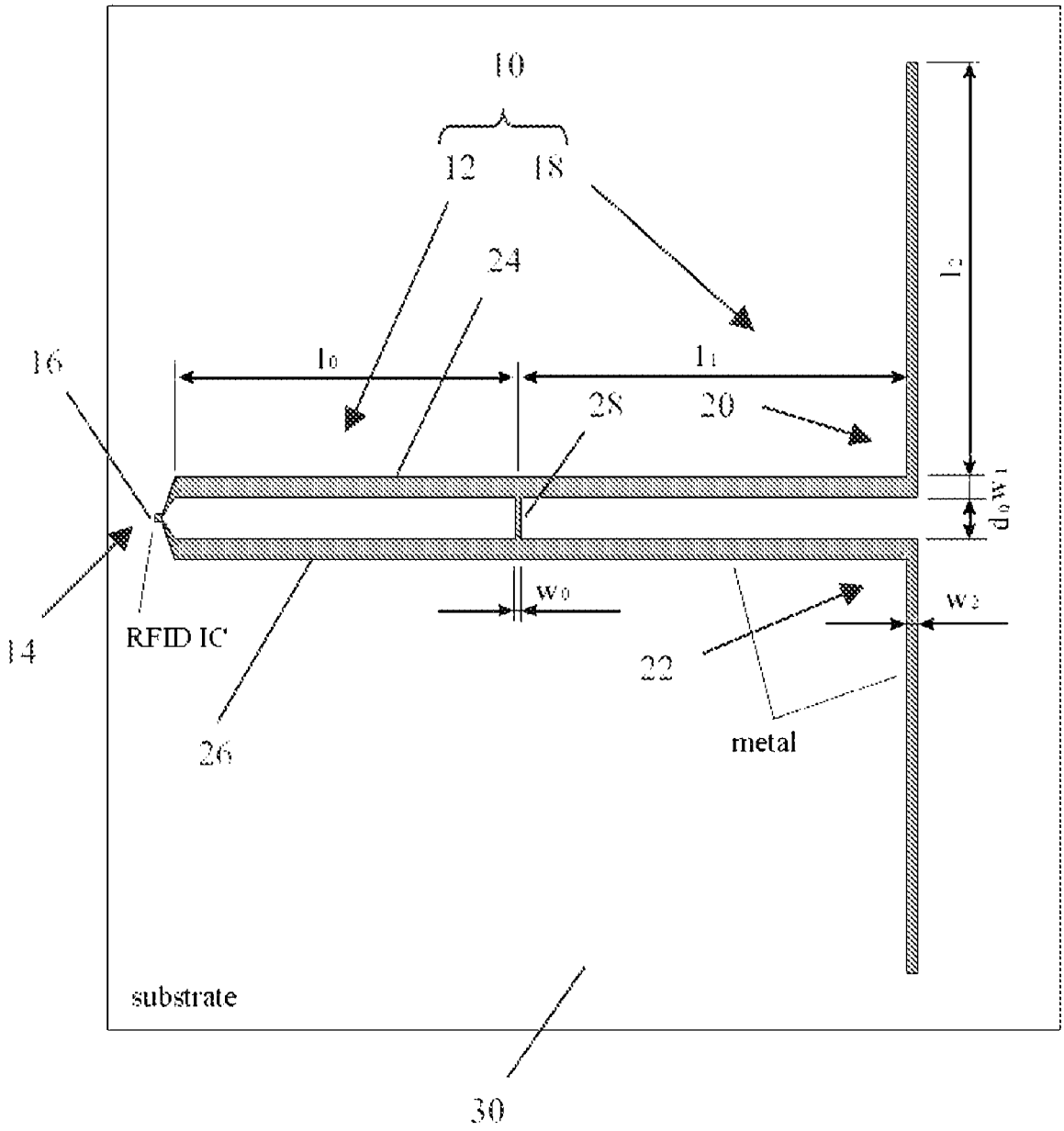
FIG. 1 shows a first embodiment of an antenna for a RFID transponder according to the invention.

Identical, similar, and functional identical or similar elements can be denoted with the same reference numerals in the following description.

FIG. 1 shows an electrically isolating substrate 30 onto which an antenna 10 and a RFID integrated circuit 16 is mounted. The substrate 30 may be made of plastic, ceramic, plastic with embedded ceramic particles, etc., and has a dielectric constant $\in_r$ equal or larger than 1 and a permeability coefficient $\mu r$ equal or larger than 1. The antenna 10 may be implemented as an electrically conductive metallization, for example Cu, Au, Ag, Al, etc. deposited on or embedded into the substrate 30. The metallization may be structured by known methods such as etching, milling, printing, imprinting, or pasting and deposited on the substrate 30. The RFID transponder is formed by the antenna 10 and the RFID IC 16 connected to a so-called feedpoint 14 of the antenna 10. In fact the feedpoint 14 is realized by means of two tiny connection legs or wires, which are designed such that they allow to be connected with the RFID IC 16. The connection of the RFID IC 16 to the feedpoint 14 may be implemented by the usual methods such as axial, SMD, bonding, flip-chip, etc.

The antenna 10, shown in FIG. 1, comprises a loop resonator 12 with the said feedpoint 14 connected to the RFID IC 16, and a dipole resonator 18 connected to the loop resonator 12. The loop resonator 12 is implemented by a symmetrical metallization structure comprising two lines 24 and 26 of length $l_0$ arranged in parallel at a distance $d_0$. Each of the lines 24 and 26 has a width $w_1$. One end of the lines 24 and 26 forms the feedpoint 14 of the antenna 10 at which the RFID IC 16 is electrically connected to the antenna 10. The other ends of the lines 24 and 26 are coupled by a short circuit 28 which electrically connects the ends of the two lines 24 and 26. The short circuit 28 has the width $w_0$ and the length $d_0$.

Each of the lines 24 and 26 of the loop resonator 12 is electrically connected to a respective leg 20 and 22 of the dipole resonator 18 of the antenna 10. Thus, the antenna 10 comprises two parts each formed by a line of the loop resonator and a leg of the dipole resonator, wherein the parts are electrically connected by the short circuit 28 at a predefined distance from the feedpoint of the antenna. The legs 20 and 22 of the dipole resonator 18 are arranged in parallel over a predefined length $l_t$. Each leg 20 and 22 has a width $w_1$ while arranged in parallel. The legs 20 and 22 diverge at a distance $l_1$ from the short circuit 28. Then the legs 20 and 22 have a width $w_2$ and length $l_2$ and are arranged to form a typical dipole antenna structure.

The complex antenna design shown in FIG. 1 allows implementing antenna impedance with a resonance spectrum adapted for the purposes of using a RFID transponder in different frequency ranges as will be explained in the following in more detail. The typical input parameter of an antenna are the scattering parameter $s_{11}$ and the complex impedance $Z_{antenna}$ of the antenna. The scattering parameter $s_{11}$ is a measure for the reflection between a load and a source. In case of load matching, the reflection is 0. The scattering parameter $s_{11}$ is defined as follows:

$$s_{11}=k*\mathrm{Log}(|\mathrm{gamma}|) \text{ with } \mathrm{gamma}=(Z-Z0^*)/(Z+Z0)$$

wherein Z is the complex load impedance and Z0 is the complex source impedance; k=10 in case of power, and k=20 in case of voltages or currents.

Figure 2:
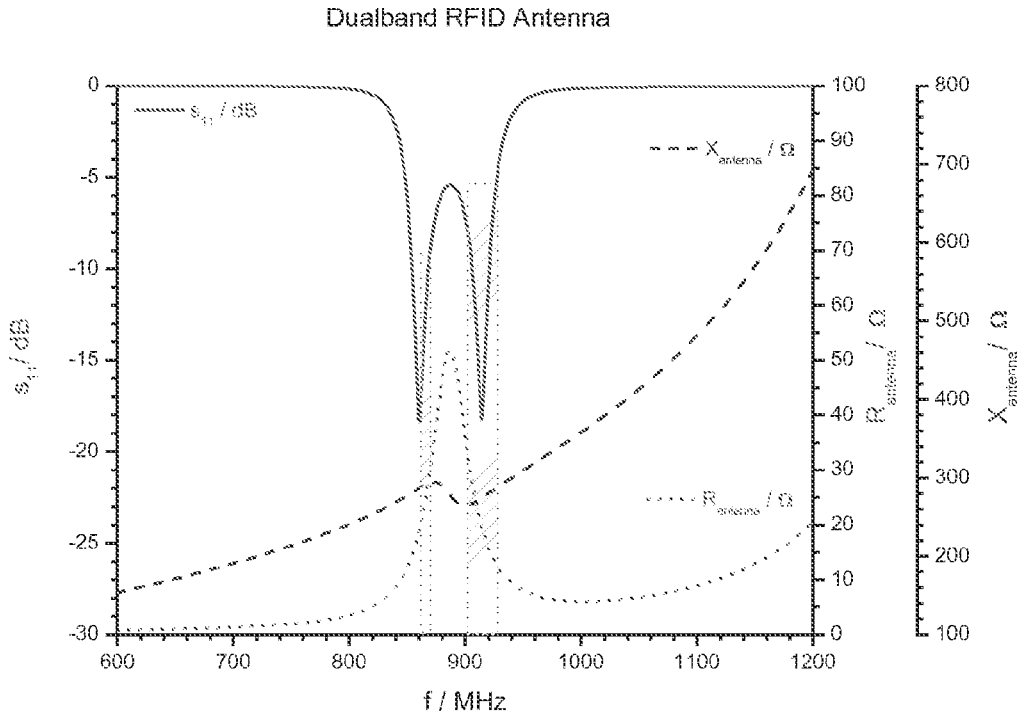
FIG. 2 shows a diagram with the courses over the frequency of the scattering parameter $s_{11}$ and the real and imaginary part of the impedance of an optimized antenna of a RFID transponder according to the invention.

FIG. 2 shows the course of the scattering parameter $s_{11}$ and of the real $R_{antenna}$ and $X_{antenna}$ imaginary part of the complex antenna impedance $Z_{antenna}$ over the frequency for an optimized antenna with a structure as shown in FIG. 1. The antenna is designed such that it works for both the frequency range from about 902 to about 928 MHz in the USA and the frequency range from about 863 to about 868 MHz in the EU (shaded areas in FIG. 2). A RFID IC impedance of (15−j 270) Ohm was selected as reference impedance. As can be seen from FIG. 2, both frequency areas are covered by distinctive resonances of the antenna. This ensures a good adoption to the RFID IC which is a prerequisite for an efficient RFID transponder.

The complexity of the antenna offers a plurality of parameters which may be used to modify the behaviour of the antenna and to adapt the antenna to predetermined conditions. Particularly, the following characteristics of the antenna may be optimized:

- adoption of the input impedance of the antenna to the output impedance of the RFID IC in order to minimize reflections between the antenna and the RFID IC,
- maximizing the radiation efficiency of the antenna, and
- a as much as possible broadband impedance matching between antenna and RFID IC.

As explained above, the antenna according to the invention comprises two distinctive resonances. The frequency ranges of both resonances may be adapted such that an optimal impedance matching to a RFID IC output impedance may be achieved within given frequency ranges, for example the frequency range from about 902 to about 928 MHz in the USA and the frequency range from about 863 to about 868 MHz in the EU. Because of the complexity of the antenna design according to the invention and shown in FIG. 1 and the complex coupling mechanism connected therewith, a change of a single design parameter of the antenna such as a dimension of a part of the antenna usually may significantly influence the antennas frequency spectrum. In principle, the complex coupling mechanism may be reduced to the following two aspects:

- loop resonator structure R1 defined by the parameters $l_0$, $w_1$, $d_0$, and
- dipole resonator R defined by the parameters $l_1$, $l_2$, $w_1$, $w_2$, and $d_0$.

A further important parameter is the width $w_0$ and/or length $d_0$ of the coupling or the shorting circuit.

The structure R1 may also be regarded as a conducting track loop, and the structure R1 as dipole antenna with an integrated impedance matching. The novel and inventive combination of these two structures according to the invention as well as the way of coupling both structures allow achieving a resonance spectrum suitable for operating a RFID transponder in a broad frequency range.

The invention has the advantage that a RFID transponder may be operated in a broad frequency range covering at least two frequency ranges provided for RFID systems. Furthermore, the invention may be implemented at low cost and does not require a DC short circuit structure for electronics operated with embodiments of an antenna according to embodiments of the invention.

As mentioned above, the matching of the antenna impedance to the RFID IC output impedance may be influenced by adapting certain design parameters of the antenna such as the coupling of the loop resonator and dipole resonator as well as dimensions of the structures of the antenna such as width, length and distance. In the following, the influence of modifying certain parameters such as the values $l_0$, $w_0$, $d_0$, $l_1$, $w_1$, $l_2$, $w_2$ on the antenna impedance and its frequency spectrum will be discussed in detail with regard to diagrams showing the course of the scattering parameter $s_{11}$ and the real and imaginary part $R_{antenna}$ and $X_{antenna}$ of the antenna impedance $Z_{antenna}$ over a frequency range from about 800 MHz to about 1 GHz.

Figure 3:
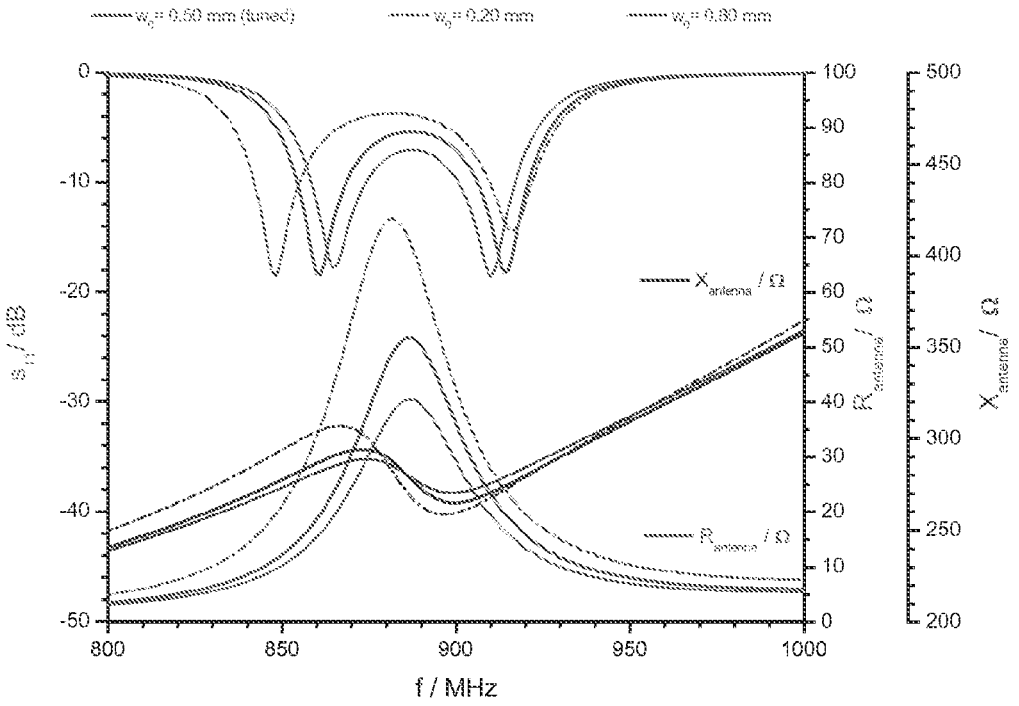
FIG. 3 shows a diagram with the courses over the frequency of the scattering parameter $s_{11}$ and the real and imaginary part of the impedance of an antenna of a RFID transponder according to the invention as a function of the width w0 of the coupling of the lines of the loop resonator.

As a first parameter, the width $w_0$ of the short circuit 28 is modified to 0.2 mm, 0.5 mm, and 0.8 mm. FIG. 3 shows the course of the scattering parameter $s_{11}$ and the real and imaginary part $R_{antenna}$ and $X_{antenna}$ of the antenna impedance $Z_{antenna}$ over a frequency range from about 800 MHz to about 1 GHz. It should be noted that the frequency of the maximum of the real part $R_{antenna}$ is nearly constant. However, the amplitude of the real part $R_{antenna}$ significantly changes. At the same time, the imaginary part $Z_{antenna}$ is merely slightly influenced such that the influence on the antenna impedance is small. Thus, the width $w_0$ of the short circuit 28 may be used to adapt the real part $R_{antenna}$ of the antenna impedance $Z_{antenna}$.

It should be noted that FIG. 3 also shows that a widening of the metallization the resonance frequencies get closer (or in other words, Δf is reduced), and a reduction of the width of the metallization increases Δf.

Figure 4:
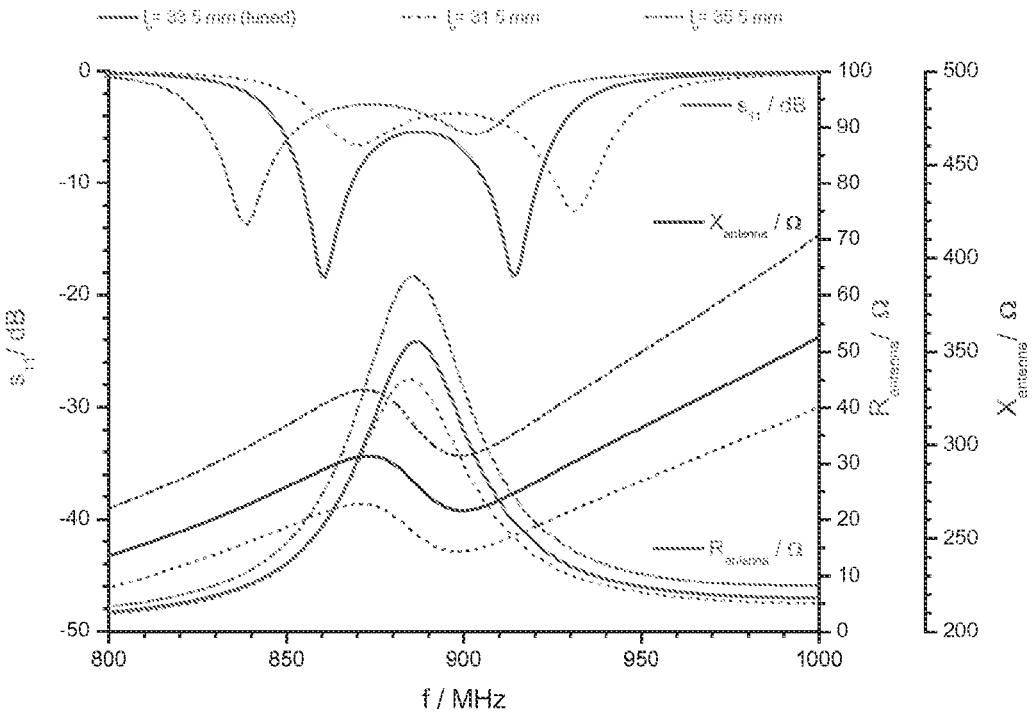
FIG. 4 shows a diagram with the courses over the frequency of the scattering parameter $s_{11}$ and the real and imaginary part of the impedance of an antenna of a RFID transponder according to the invention as a function of the length $l_0$ of the lines of the loop resonator.

Next, the length $l_0$ of the short circuit 28 is modified to 33.5 mm, 31.5 mm, and 35.5 mm. FIG. 4 shows the course of the scattering parameter $s_{11}$ and the real and imaginary part $R_{antenna}$ and $X_{antenna}$ of the antenna impedance $Z_{antenna}$ over a frequency range from about 800 MHz to about 1 GHz. Also, the frequency of the maximum of the real part $R_{antenna}$ is nearly constant and the amplitude of the real part $R_{antenna}$ significantly changes. In contrast to FIG. 3, the imaginary part $X_{antenna}$ is significantly changed so that also the resonance frequencies are shifted.

Figure 5:
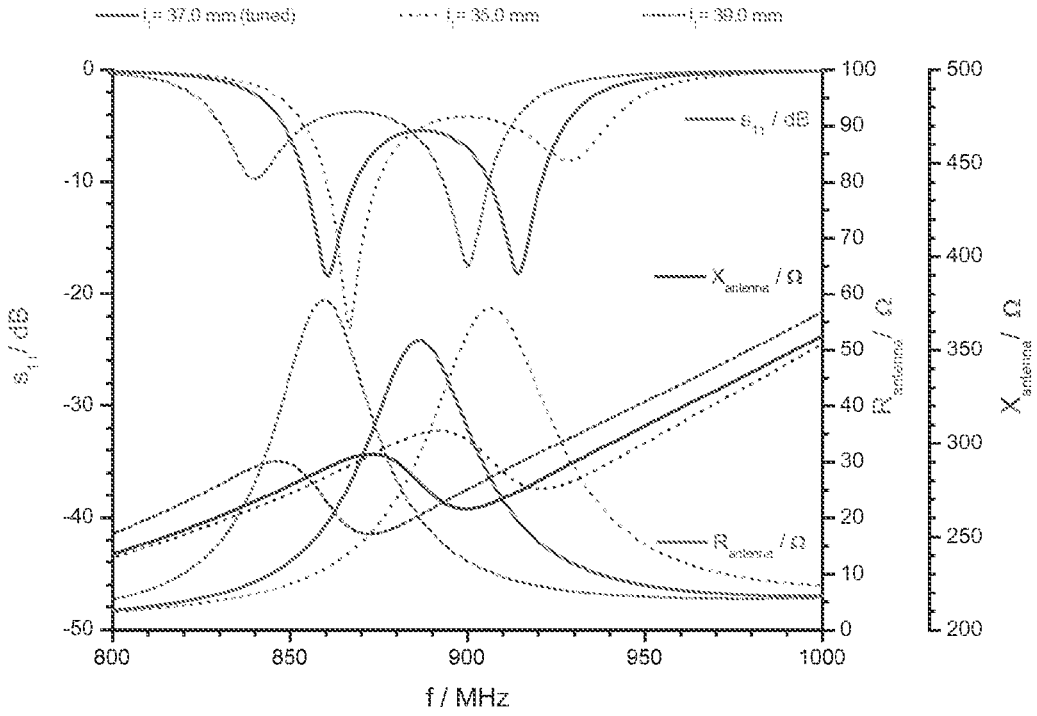
FIG. 5 shows a diagram with the courses over the frequency of the scattering parameter $s_{11}$ and the real and imaginary part of the impedance of an antenna of a RFID transponder according to the invention as a function of the length $l_1$ of parts of the legs of the dipole resonator.

FIG. 5 shows the influence of a modification of the length $l_1$ of the parallel section of the legs 20 and 22 of the dipole resonator 18. The length $l_1$ is modified to 37.0 mm, 35.0 mm, and 39.0 mm. In contrast to FIGS. 3 and 4, the frequency of the maximum of the real part $R_{antenna}$ is significantly changed while the amplitude of the real part $R_{antenna}$ remains nearly constant. The imaginary part $X_{antenna}$ is moved to higher or lower frequencies.

Figure 6:
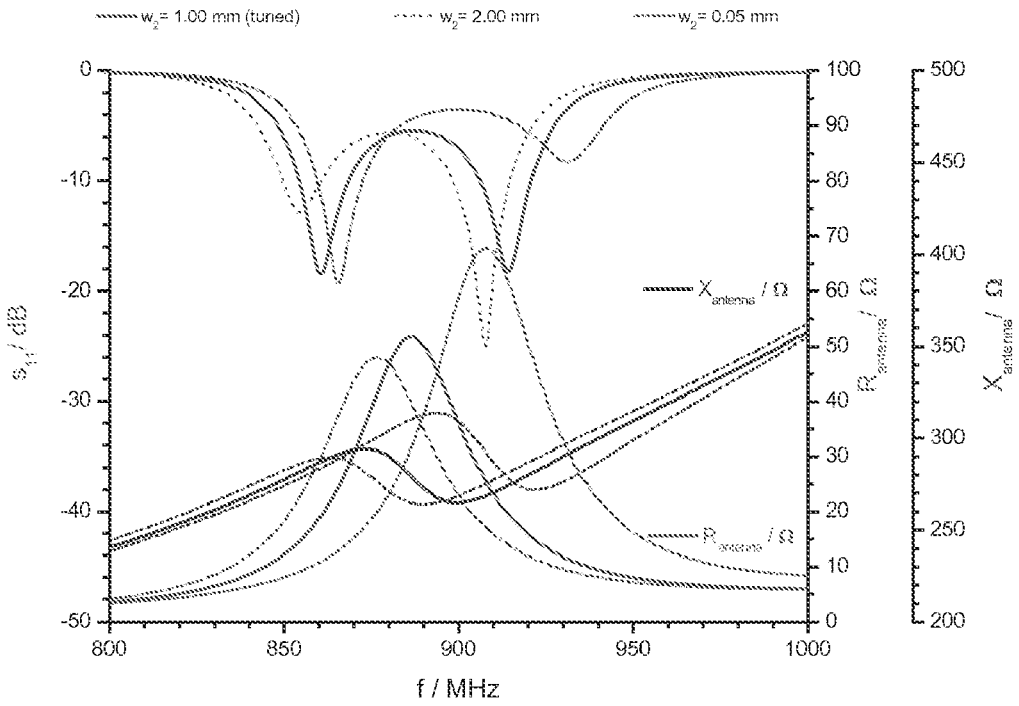
FIG. 6 shows a diagram with the courses over the frequency of the scattering parameter $s_{11}$ and the real and imaginary part of the impedance of an antenna of a RFID transponder according to the invention as a function of the width $w_2$ of parts of the legs of the dipole resonator.

FIG. 6 shows the influence of a modification of the width $w_2$ of the diverging legs of the dipole resonator 18. The width $w_2$ is modified to 1.0 mm, 2.0 mm, and 0.05 mm. In all modifications described above, the frequency and amplitude of the maximum of the real part $R_{antenna}$ is significantly changed. This results in a significant modification of the location of the higher resonance frequency of the impedance. Also, the location and amplitude of the imaginary part $X_{antenna}$ is modified. Thus, by changing the width $w_2$ the resonance frequencies of the antenna impedance may be significantly changed.

Figure 7:
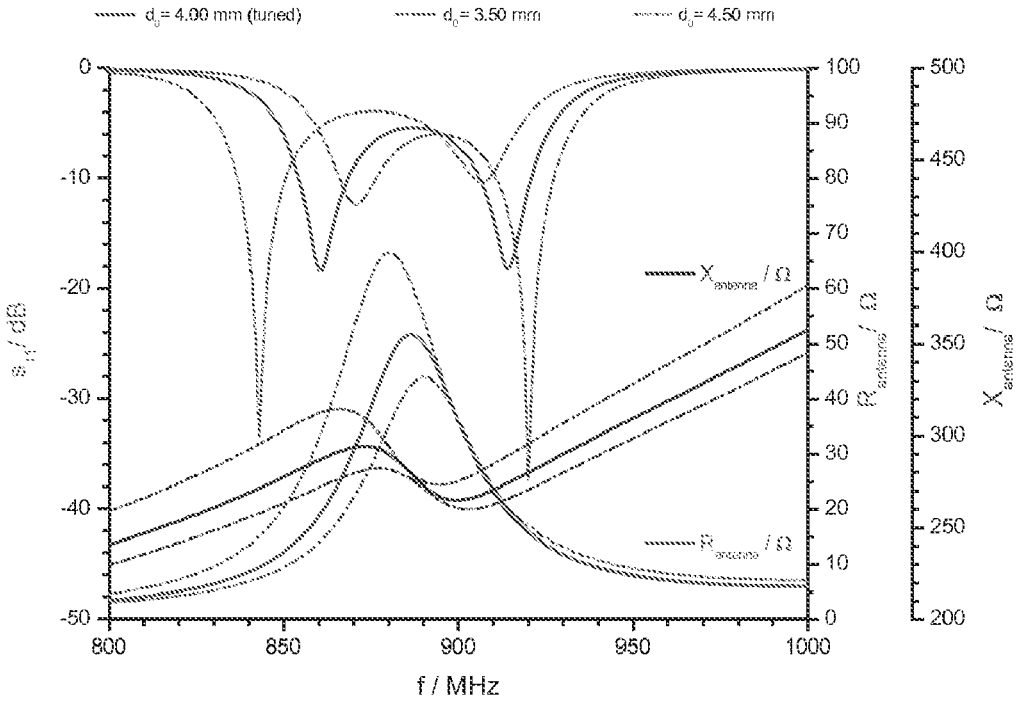
FIG. 7 shows a diagram with the courses over the frequency of the scattering parameter $s_{11}$ and the real and imaginary part of the impedance of an antenna of a RFID transponder according to the invention as a function of the distance $d_0$ of lines of the loop resonator.

Finally, the influence of a modification of the distance $d_0$ between the metallization with the lengths $l_0$ and $l_1$ is shown in FIG. 7. The distance is modified to 4.0 mm, 3.5 mm, and 4.5 mm. The influence of the modification is similar as the modification of the width $w_2$ (FIG. 6). It should be noted that the falling edge of the real part $R_{antenna}$ is constant for all modifications. Thus, the location of the lower resonance frequency of the antenna impedance is more influenced than the location of the higher resonance frequency.

The above description has shown how modifications of certain parameters of the antenna according to the invention influence the course of the antenna impedance over the frequency and, thus, may be used to adapt matching the antenna impedance to an output impedance of an electronic circuit such as a RFID IC. However, it should be noted that the diagrams shown in FIG. 2 to 7 merely show exemplary courses of certain embodiment of the invention and do not restrict the scope of the invention to the shown courses and exemplary dimensions.

Figure 8:
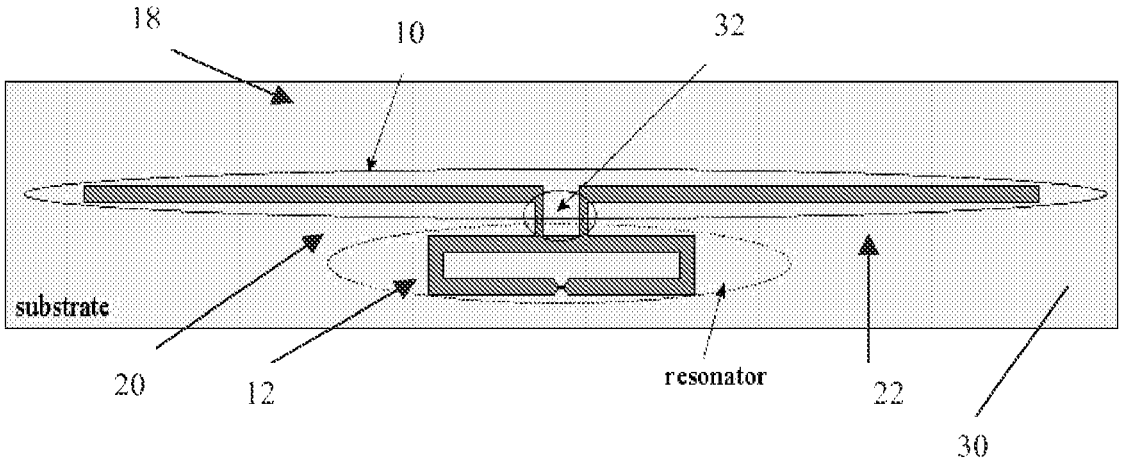
FIG. 8 shows a second embodiment of an antenna for a RFID transponder according to the invention.

FIG. 8 shows a further antenna 10 with a different design than the antenna shown in FIG. 1. The main differences are the dimensions of the loop resonator 12 and of the dipole resonator 18. The loop resonator 12 is formed such that it is arranged essentially in parallel to the dipole resonator 18. Furthermore, the connecting structure 32 between the loop resonator 12 and dipole resonator 18 containing the parallel parts of the legs 20 and 22 of the dipole resonator 18 is significantly reduced compared to the antenna shown in FIG. 1. This antenna has a similar electrical behaviour as the antenna shown in FIG. 1, however, has smaller dimensions such that less material is required and a higher grade of miniaturization may be achieved. This increases the number of potential applications.

Figure 9:
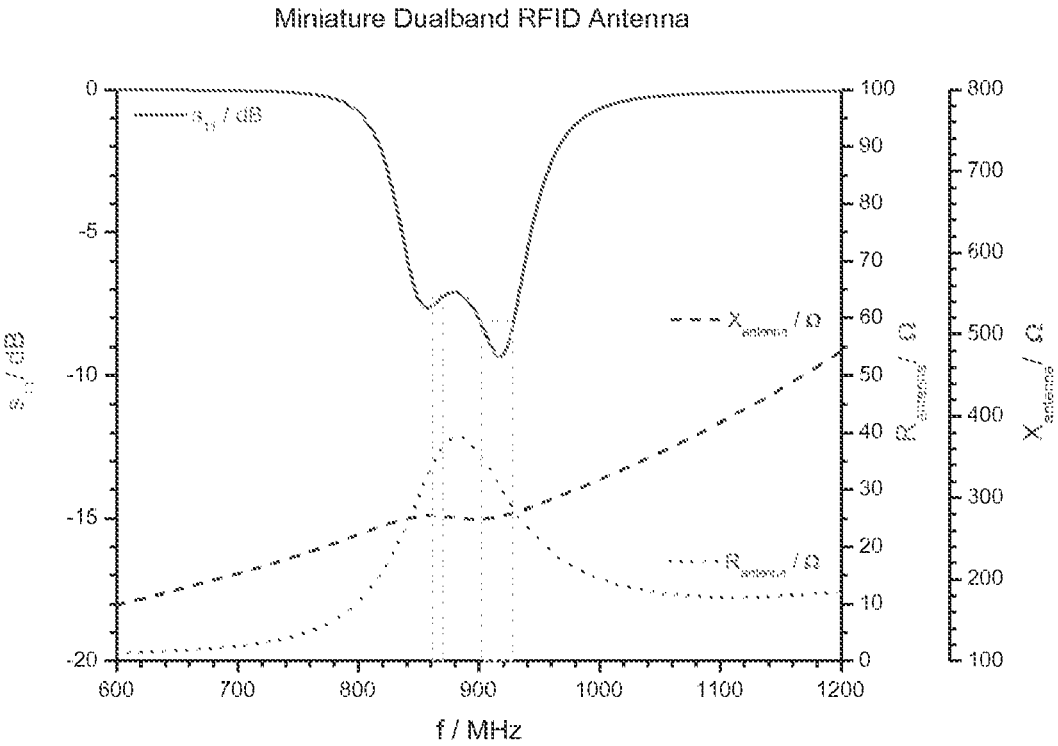
FIG. 9 shows a diagram with the courses over the frequency of the scattering parameter $s_{11}$ and the real and imaginary part of the impedance of an optimized antenna of a RFID transponder according to the invention.

FIG. 9 shows the course of the scattering parameter $s_{11}$ and the real and imaginary part $R_{antenna}$ and $X_{antenna}$ of the antenna impedance $Z_{antenna}$ over a frequency range from about 800 MHz to about 1 GHz for an exemplary embodiment of the antenna of FIG. 8. As can be seen, the resonance spectrum is also relatively broad and covers the frequency bands provided for RFID operation in the EU and the US.

The invention has the advantage that the impedance of an antenna for a RFID transponder may be adapted to the output impedance of an electronic circuit if the RFID transponder such that a broad frequency range may be covered for transmission of data. Particularly, a number of design parameters such as dimensions of antenna elements may be modified for the adoption of the antenna impedance. Furthermore, the antenna according to the invention has a relatively simple structure so that the antenna may be produced at low cost and merely requires one layer. Furthermore, the antenna may be dimensioned such that it can be implemented on very small substrates.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A broadband antenna for a transponder of a radio frequency identification system comprising:

a loop resonator with a feedpoint for connecting with an electronic circuit, and a dipole resonator electrically connected to the loop resonator and comprising two electrically isolated legs, wherein the loop resonator comprises two electrical lines, wherein:

one end of each line is provided for connecting with the electronic circuit, the other end of each line is coupled to a respective one of the two electrically isolated legs of the dipole resonator, and a coupling couples the other ends of the two lines.

2. An antenna as claimed in claim 1, wherein the coupling is an electrical connection forming a short circuit of the two lines.

3. An antenna as claimed in claim 1, wherein the coupling is a capacitive coupling structure.

4. An antenna as claimed in claim 1, wherein the coupling is formed by a capacitor.

5. An antenna as claimed in claim 1, wherein the dimensions and arrangement of the two electrical lines are selected such that the antenna shows at least two resonance bands in which the antenna is in a matched condition with the electronic circuit, wherein one of the two resonance bands lies in a first frequency range and the other one of the two resonance bands lies in a second frequency range different from the first frequency range.

6. An antenna as claimed in claim 1, wherein the lines are arranged in parallel.

7. An antenna as claimed in claim 6, wherein each of the lines has a predefined length and width, and both lines are arranged in a predefined distance, wherein the predefined length, width, and distance are selected such that the antenna shows at least two resonance bands in which the antenna is in a matched condition with the electronic circuit, wherein one of the two resonance bands lies in a first frequency range and the other one of the two resonance bands lies in a second frequency range different from the first frequency range.

8. An antenna as claimed in claim 7, wherein the coupling is an electrical connection with a predefined width.

9. An antenna as claimed in claim 1, wherein the two electrically isolated legs of the dipole resonator are arranged over a predefined length in parallel.

10. An antenna as claimed in claim 9, wherein both legs are arranged at the same predefined distance of the lines of the loop resonator.

11. An antenna as claimed in 9, wherein both legs have a first predefined width essentially equal to the width of the lines of the loop resonator at least for the predefined length for which they are arranged in parallel.

12. An antenna as claimed in claim 9, wherein both legs diverge over a second predefined length after being arranged in parallel over a first predefined length and have a second predefined width.

13. An antenna as claimed in claim 1, wherein electrically conducting parts of the antenna are electrically conducting metallization deposited on or embedded into a substrate having a dielectric constant equal or larger than 1 and a permeability coefficient equal or larger than 1.

14. A transponder of a radio frequency identification system comprising an antenna as claimed in claim 1 and an electronic circuit to which the antenna is connected at its feedpoint.

15. A broadband antenna for a transponder of a radio frequency identification system comprising:

a loop resonator with a feedpoint for connecting with an electronic circuit, and a dipole resonator electrically connected to the loop resonator and comprising two electrically isolated legs, wherein both legs diverge over a second predefined length after being arranged in parallel over a first predefined length and have a second predefined width.

16. An antenna as claimed in claim 15, wherein both legs are arranged at the same predefined distance of the lines of the loop resonator.

17. An antenna as claimed in 15, wherein both legs have a first predefined width essentially equal to the width of the lines of the loop resonator at least for the predefined length for which they are arranged in parallel.

18. A broadband antenna for a transponder of a radio frequency identification system comprising:

a loop resonator with a feedpoint for connecting with an electronic circuit, and a dipole resonator electrically connected to the loop resonator and comprising two electrically isolated legs, wherein electrically conducting parts of the antenna are electrically conducting metallization deposited on or embedded into a substrate having a dielectric constant equal or larger than 1 and a permeability coefficient equal or larger than 1.

* * * * *